US012187386B2

(12) United States Patent
Messick et al.

(10) Patent No.: US 12,187,386 B2
(45) Date of Patent: Jan. 7, 2025

(54) CONVERTIBLE BIMINI TOPS FOR MARINE VESSELS

(71) Applicant: Brunswick Corporation, Mettawa, IL (US)

(72) Inventors: Blake M. Messick, Rockledge, FL (US); Carrie A. Fodor, Cape Canaveral, FL (US); Jeffery Joseph Lee King, Cocoa, FL (US); Kristin M. McGinnis, Cocoa Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 418 days.

(21) Appl. No.: 17/579,674

(22) Filed: Jan. 20, 2022

(65) Prior Publication Data

US 2022/0234688 A1 Jul. 28, 2022

Related U.S. Application Data

(60) Provisional application No. 63/141,568, filed on Jan. 26, 2021.

(51) Int. Cl.
*B63B 17/02* (2006.01)
*B63J 3/00* (2006.01)

(52) U.S. Cl.
CPC ..... *B63B 17/02* (2013.01); *B63J 3/00* (2013.01); *B63J 2003/002* (2013.01)

(58) Field of Classification Search
CPC .. B63B 17/00; B63B 17/02; B63J 3/00; B63J 2003/002
USPC ..... 114/361
See application file for complete search history.

(56) References Cited

U.S. PATENT DOCUMENTS

| | | | |
|---|---|---|---|
| 6,152,156 | A | 11/2000 | Tung |
| 6,273,771 | B1 | 8/2001 | Buckley et al. |
| 7,438,015 | B1 | 10/2008 | Schwindaman |
| 7,798,089 | B2 | 9/2010 | McKeand |
| 8,495,967 | B2 | 7/2013 | Williams et al. |
| 8,522,709 | B2 | 9/2013 | Williams et al. |
| 9,027,500 | B2 | 5/2015 | Williams et al. |

(Continued)

FOREIGN PATENT DOCUMENTS

DE 19951619 4/2011

OTHER PUBLICATIONS

Extended European Search Report issued in Corresponding European Patent Application No. 22153141.1, dated Jul. 1, 2022.

(Continued)

*Primary Examiner* — Lars A Olson
(74) *Attorney, Agent, or Firm* — Andrus Intellectual Property Law, LLP

(57) ABSTRACT

A convertible bimini top for a marine vessel has a cover frame, a support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, and an upper actuator coupled to the upper end of the support arm and to the cover frame, the upper actuator being configured to pivot the cover frame relative to the support arm.

11 Claims, 8 Drawing Sheets

(56) References Cited

U.S. PATENT DOCUMENTS

| | | | |
|---|---|---|---|
| 9,061,748 | B2 | 6/2015 | Metcalf |
| 9,114,854 | B2 | 8/2015 | Williams et al. |
| 9,114,855 | B2 | 8/2015 | Nemeth |
| 9,139,259 | B2 | 9/2015 | Williams et al. |
| 9,302,742 | B2 | 4/2016 | Williams et al. |
| 9,434,451 | B1 | 9/2016 | Ostmeyer et al. |
| 9,926,045 | B1 | 3/2018 | Ostmeyer et al. |
| 10,118,671 | B2 | 11/2018 | Gharabegian |
| 10,198,005 | B2 | 2/2019 | Arbuckle et al. |
| 10,207,778 | B1 | 2/2019 | Bohanan et al. |
| 10,286,982 | B2 | 5/2019 | Sheedy et al. |
| 10,562,595 | B2 | 2/2020 | Williams et al. |
| 10,597,119 | B1 | 3/2020 | Lambert et al. |
| 10,800,493 | B2 | 10/2020 | Sheedy et al. |
| 10,820,672 | B2 | 11/2020 | Gharabegian |
| 10,858,072 | B1 | 12/2020 | Riordan et al. |
| 11,345,444 | B2 * | 5/2022 | Mills ..... B63B 17/02 |
| 2013/0104793 | A1 | 5/2013 | Pierce et al. |
| 2014/0041555 | A1 | 2/2014 | Ramberg |
| 2017/0323154 | A1 | 11/2017 | Kollmann et al. |
| 2018/0186433 | A1 | 7/2018 | Gharabegian |
| 2019/0375484 | A1 | 12/2019 | Wilson et al. |
| 2020/0247158 | A1 | 8/2020 | Daniels et al. |
| 2020/0407020 | A1 | 12/2020 | Riordan et al. |

OTHER PUBLICATIONS

Response to the Extended European Search Report filed in Corresponding European Patent Application No. 22153141.1, on Feb. 2, 2023.

Office Action issued in Corresponding European Patent Application No. 22153141.1, on Jun. 4, 2024.

Office Action issued in U.S. Appl. No. 17/711,224, dated Sep. 28, 2024.

* cited by examiner

CONVERTIBLE BIMINI TOPS FOR MARINE VESSELS

CROSS-REFERENCE TO RELATED APPLICATION

The present utility patent application claims priority to and the benefit of U.S. Provisional Patent Application No. 63/141,568, which is incorporated herein by reference in entirety.

FIELD

The present disclosure relates to marine vessels and particularly to convertible bimini tops for marine vessels.

BACKGROUND

The following U.S. Patents are incorporated herein by reference:

U.S. Pat. No. 6,273,771 discloses a control system for a marine vessel, which incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 9,434,451 discloses a foldable watersports tower which is mountable on a boat and configured to serve as both a watersports tower and to provide support for a sun cover. The tower includes a cover frame and a leg supporting the cover frame. The leg includes a first leg section having a lower end and an upper end. The lower end of the first leg section is pivotally mountable adjacent the boat at a first lower pivot location, and the upper end of the first leg section is pivotally connected to the cover frame at a first upper pivot location. The leg includes a second leg section having a lower end and an upper end. The lower end of the second leg section is pivotally mountable adjacent the boat at a second lower pivot location. The upper end of the second leg section is pivotally connected to the cover frame at a second upper pivot location. The tower is foldable so as to be raisable and lowerable between a raised position and a lowered position and the cover frame is capable of remaining in a constant attitude as the tower travels between the raised position and the lowered position.

U.S. Pat. No. 9,139,259 discloses a folding bimini top having a vertical arch member which may be pivotally raised and lowered or released relative to a boat hull, and a lateral support member which can receive a sun cover or cargo, and which has a first portion pivotally connected to the arch member and a second portion which releasably connects to the arch member via a latch.

U.S. Pat. No. 9,114,855 discloses a folding arch system for a boat which includes an arch member pivotally connected to a boat hull and pivotally position-able relative to the boat hull between a raised position and a lowered position. A lateral support is pivotally connected to the vertical arch. A rigid canopy is pivotally connected to the arch member and yield-ably coupled to the lateral support. The vertical arch member and the lateral support support-ably position the rigid canopy in a predetermined horizontal orientation.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting embodiments disclosed herein, a convertible bimini top for a marine vessel has a cover frame, a support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, and an upper actuator coupled to the upper end of the support arm and to the cover frame, the upper actuator being configured to pivot the cover frame relative to the support arm.

In embodiments disclosed herein, a user input device is configured to control the lower actuator and the upper actuator. In embodiments disclosed herein, the user input device is configured to control the upper actuator independently of the lower actuator. In embodiments disclosed herein, the user input device is configured to simultaneously control the upper actuator and the lower actuator.

In embodiments disclosed herein, a controller is configured to automatically control the upper actuator and the lower actuator based upon an input to the user input device.

In embodiments disclosed herein, the user input device is configured to input a sunshade position of the cover frame to the controller, the sunshade position being angled relative to horizontal, and based upon an input via the user input device the controller is configured to automatically control the upper actuator to pivot the cover frame relative to the support arm into the sunshade position.

In embodiments disclosed herein, the user input device is configured to input a vertical position of the cover frame relative to the marine vessel to the controller, and based upon an input from the user input device the controller is configured to automatically control the lower actuator to pivot the support arm relative to the marine vessel until the cover frame is in the vertical position.

In embodiments disclosed herein, based upon the input from the user input device, the controller is configured to also control the upper actuator to pivot the cover frame relative to the support arm, to continuously maintain a horizontal orientation of the cover frame while the support arm is being pivoted relative to the marine vessel.

In embodiments disclosed herein, the user input device is provided on a remote-control device for controlling the controller and thereby raising and lowering the cover frame.

In embodiments disclosed herein, the support arm is one of port and starboard support arms, each being configured to support the cover frame above the marine vessel and having the lower end configured to be pivotably coupled to the marine vessel and the upper end pivotably coupled to the cover frame, wherein the lower actuator is one of port and starboard actuators coupled to the lower end of a respective one of the port and starboard support arms and being configured to pivot the respective one of the port and starboard support arms relative to the marine vessel to move the cover frame up and down relative to the marine vessel, wherein the upper actuator is one of port and starboard actuators, each being coupled to the upper end of a respective one of the port and starboard support arms and to the cover frame, the port and starboard upper actuators being configured to pivot the cover frame relative to the respective one of the port and starboard support arms, and further wherein the input device is configured to control the port and starboard lower actuators and the port and starboard upper actuators.

In embodiments disclosed herein, the port and starboard lower actuators are linear actuators having a first end pivotably coupled to the marine vessel and a second end pivotably coupled to the port and starboard support arms, respectively. Port and starboard lower lever arms extending from the port and starboard support arms, the second ends of the port and starboard lower actuators are pivotably coupled to the port and starboard lower lever arms, and extension and retraction of the port and starboard lower actuators pivots the port and starboard support arms about the lower pivot axes, respectively.

In embodiments disclosed herein, the port and starboard upper actuators are linear actuators having a first end pivotably coupled to the port and starboard support arms, respectively, and an opposite, second end pivotably coupled to the cover frame. Port and starboard upper lever arms extend from the port and starboard support arms, the second ends of the port and starboard upper actuators are pivotably coupled to the port and starboard upper lever arms, and extension and retraction of the port and starboard upper actuators pivots the cover frame about the upper pivot axis, in particular to maintain said substantially constant horizontal attitude of the cover frame relative to the marine vessel as the port and starboard support arms are pivoted about the lower pivot axes.

Various combinations of the above-described embodiments are contemplated, both in the particular combinations set forth in the illustrated embodiment, as well as in any other combinations not shown in the drawings but as would be well understood by one having ordinary skill in the art.

Various other features, objects, and advantages of the invention will be made apparent from the following detailed description together with the drawings.

BRIEF DESCRIPTION OF THE DRAWINGS

The present disclosure includes the following Figures.

DETAILED DESCRIPTION

Figure 1:
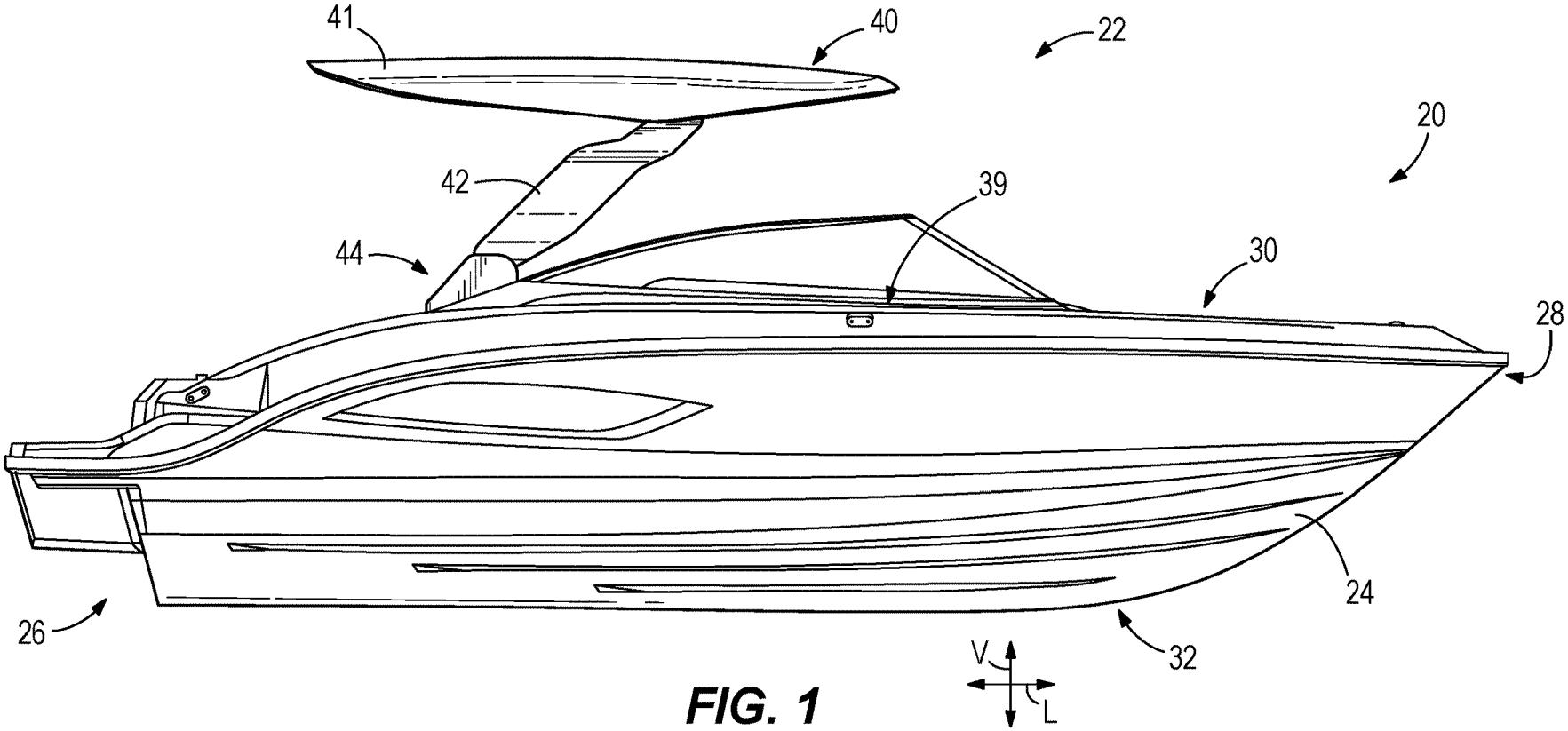
FIG. 1 is a starboard side view of a marine vessel having a convertible bimini top according to an embodiment of the present disclosure, showing the bimini top in a raised position.
Figure 2:
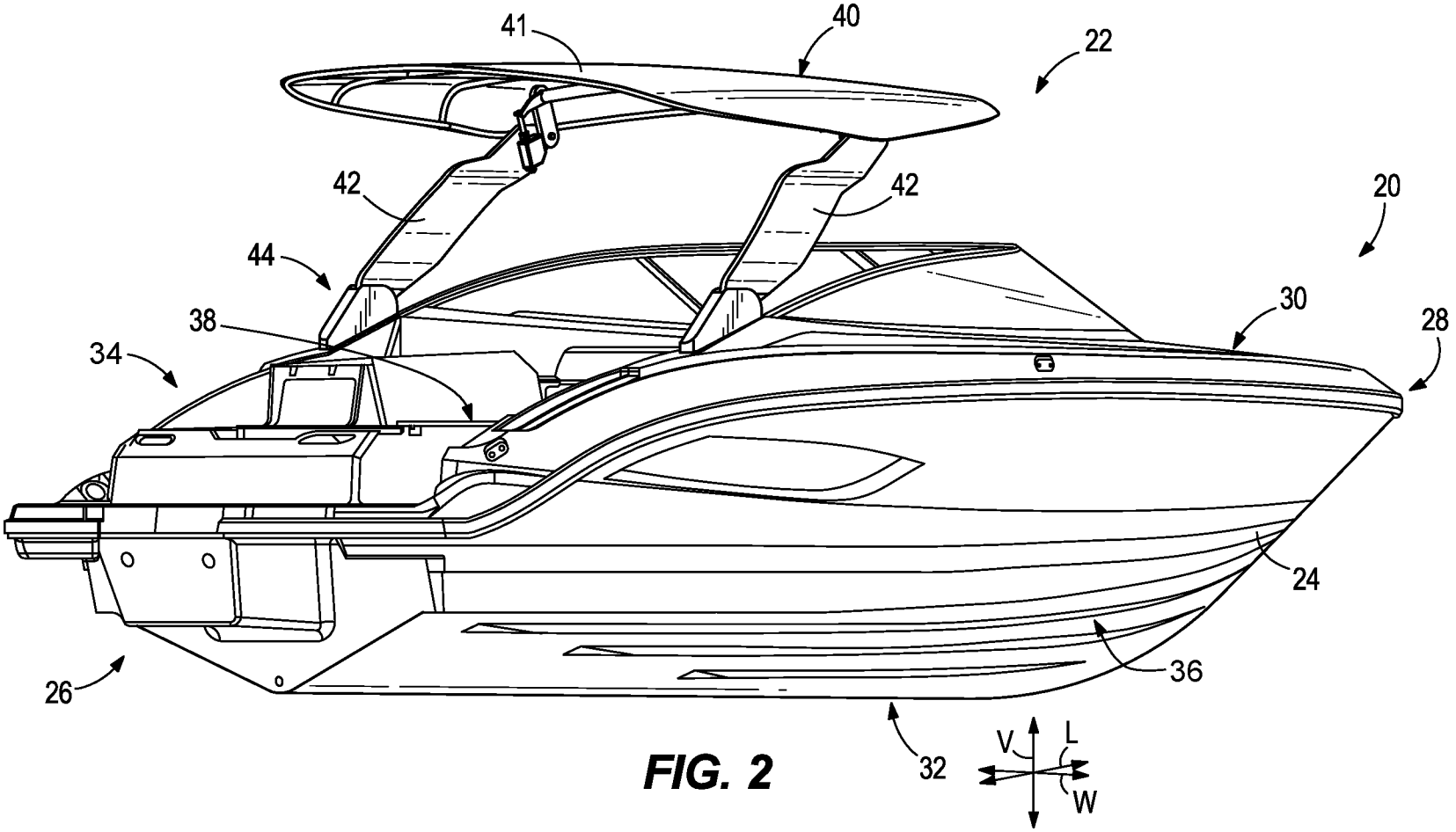
FIG. 2 is a rear, starboard side view of the marine vessel showing the bimini top in the raised position.
Figure 3:
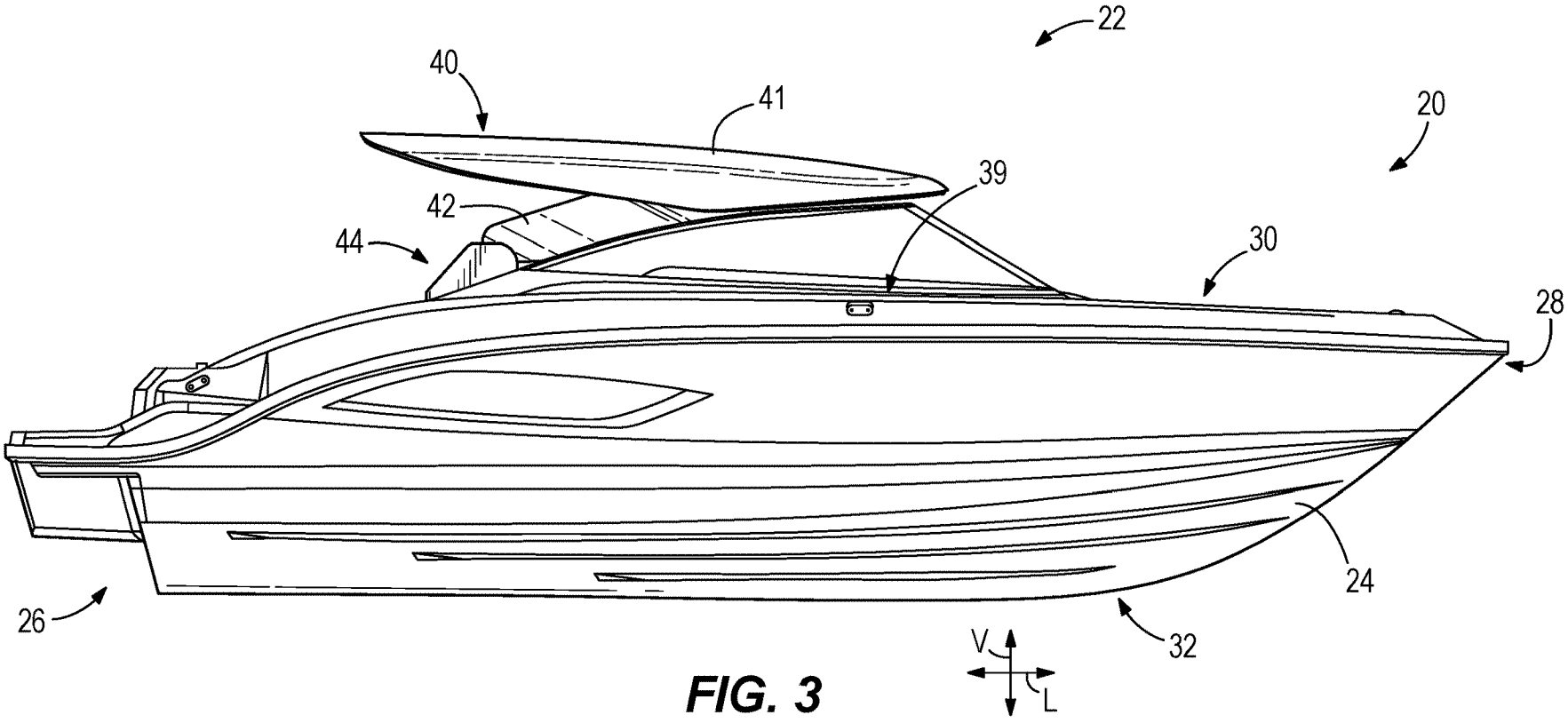
FIG. 3 is a starboard side view of the marine vessel showing the bimini top in a lowered position.
Figure 4:
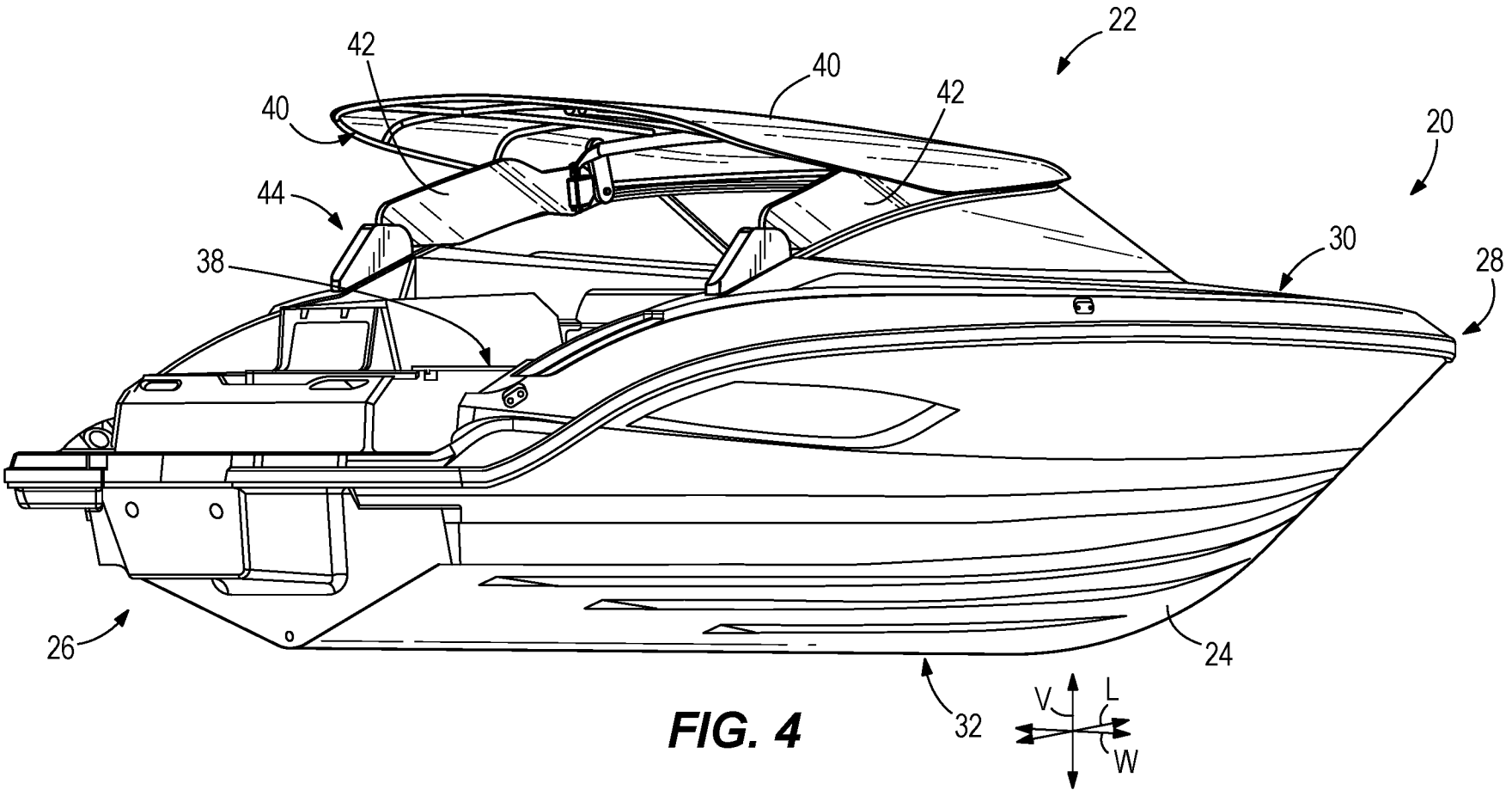
FIG. 4 is a rear, starboard side view of the marine vessel showing the bimini top in the lowered position.

During research and experimentation in the field of marine technology, and particularly regarding bimini top apparatuses for marine vessels, the present inventors have realized a desirability of providing improved bimini top apparatuses that are controllable to move into a variety of positions relative to the marine vessel. The present inventors have also realized a desirability of providing such improved bimini top apparatuses that are controllable in a way that maintains the cover frame of the bimini top in a substantially horizontal orientation as it is moved up and down relative to the marine vessel. The present inventors have also realized a desirability of providing such improved bimini top apparatuses that are controllable in a way that permits tilting or pivoting of the cover frame relative to the support arms for the cover frame and relative to the hull of the marine vessel.

Prior art bimini top apparatuses, such as disclosed in the above-incorporated U.S. Pat. No. 9,434,451, often have one or more actuators for raising and lowering the cover frame relative to the marine vessel. These actuator(s) are conventionally connected to the lower portion of the support arms of the bimini top, proximate to the hull of the marine vessel. In some embodiments, the prior art actuators are connected to the support arms via a mechanical linkage which is configured so that pivoting movement of the lower portions of the port and starboard support arms causes a corresponding pivoting movement of the cover frame. During research and experimentation, the present inventors have found that such prior art mechanical linkages are unsightly. Thus, the present inventors realized it would be desirable to provide an improved bimini top apparatus that is more streamlined than the prior art, by omitting the noted mechanical linkage but still retaining the ability to actively control the orientation of the cover frame, for example to maintain a horizontal orientation of the cover frame and/or to provide rain and/or sun cover. The present disclosure is a result of the above-described efforts.

FIGS. 1-4 illustrate a marine vessel 20 having a bimini top 22 configured according to the present disclosure. The marine vessel 20 has hull 24 which generally extends from stern 26 to bow 28 in a longitudinal direction L, from top 30 to bottom 32 in a vertical direction V which is transverse to the longitudinal direction L, and from port 34 to starboard 36 in a width direction W which is transverse to the longitudinal direction L and transverse to the vertical direction V. As conventional, the marine vessel 20 has a deck or floor, which is not shown but is generally located in the direction of arrow 38, and which generally extends in the longitudinal direction L and in the width direction W. As conventional, marine vessel 20 has a helm 39 with various operator input devices, such as for example a key switch, steering wheel, throttle, a shift lever and/or the like via which an operator of the marine vessel 20 can control movement of the marine vessel 20 in the surrounding body of water.

The bimini top 22 has a cover frame 40 which extends generally over the top of the middle of the marine vessel 20, including over the helm 39. A sheet or rain/sunshade cover 41 is attached to and supported by the cover frame 40. The shape of the cover frame 40 and cover 41 can vary from what is shown. In the illustrated embodiment, the cover frame 40 and cover 41 have a streamlined, elongated foil-shape that is aerodynamic. Port and starboard support arms 42 support the cover frame 40 above the marine vessel 20. The support arms 42 are pivotable relative to the marine vessel 20, as will be further described below.

Figure 5:
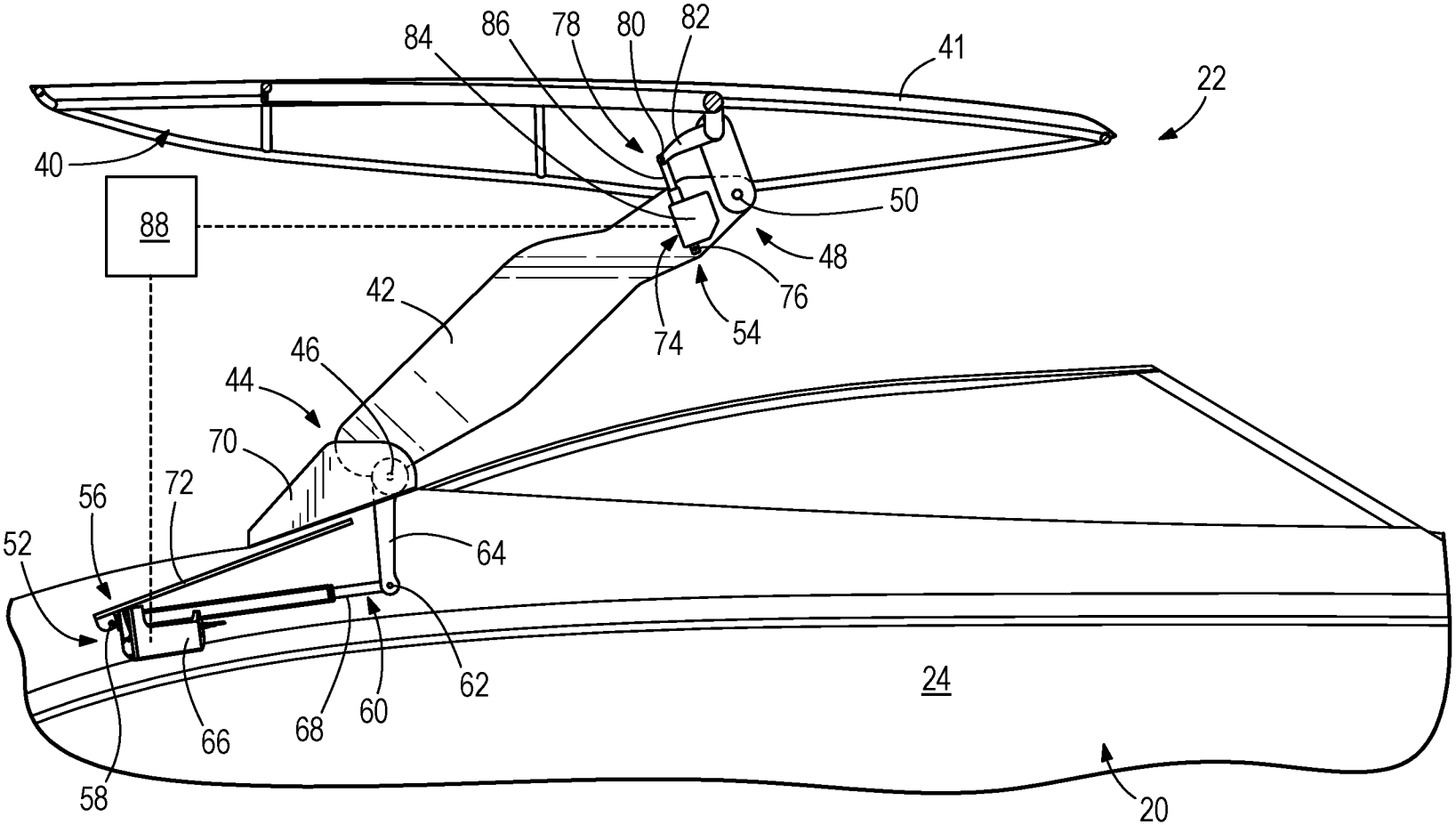
FIG. 5 is a sectional side view showing one side of the bimini top in the raised position.
Figure 6:
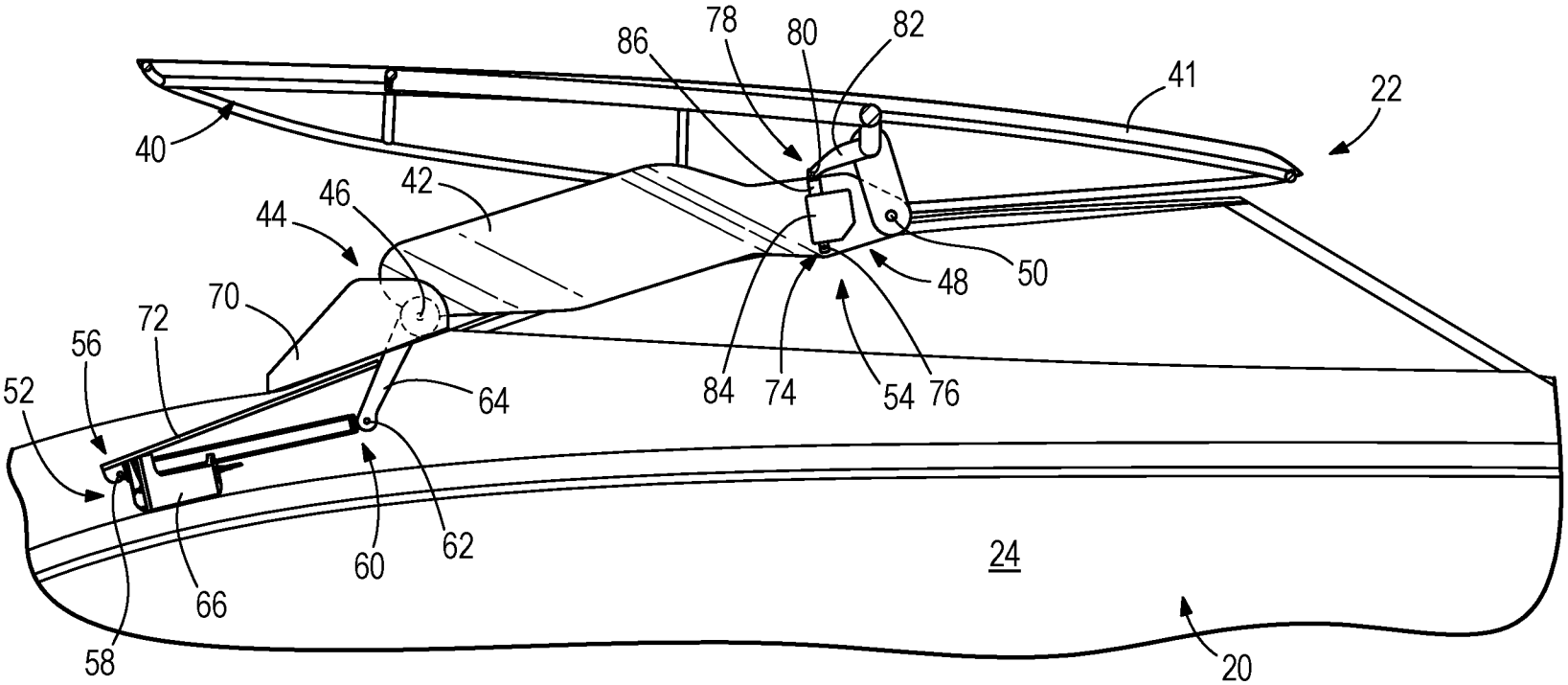
FIG. 6 is a sectional side view showing one side of the bimini top in the lowered position.
Figure 7:
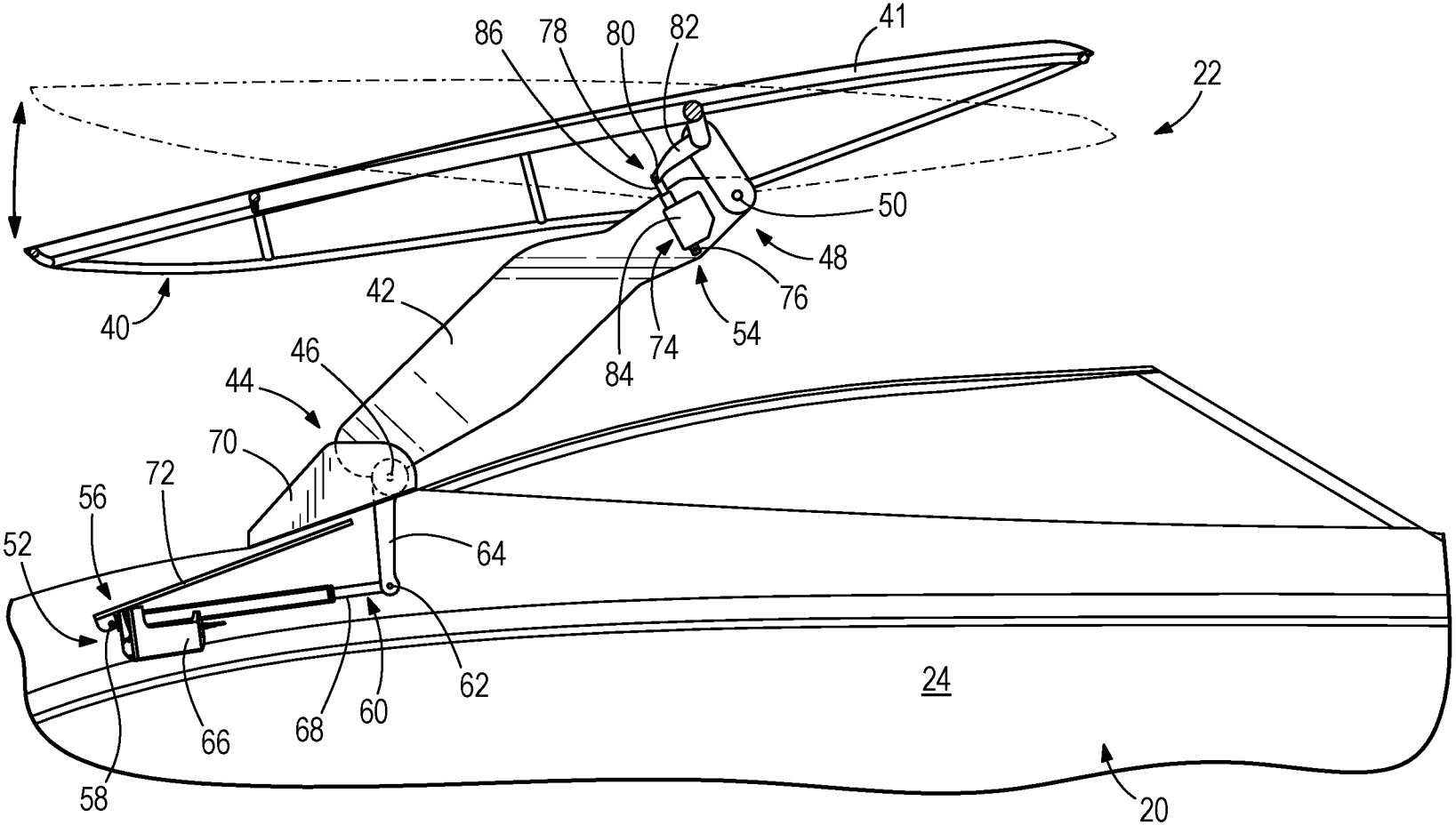
FIG. 7 is a sectional side view showing the cover frame of the bimini top in a sunshade position, in which the cover frame is angled relative to the hull of the marine vessel.

FIGS. 5 and 6 are sectional views showing only the port side of the bimini top 22, however the following description of the port side of the bimini top 22 equally applies to the starboard side of the bimini top 22. The port side of the bimini top 22 is essentially a mirror image of the starboard side of the bimini top 22. Each of the support arms 42 has a lower end 44 which is pivotably coupled to the marine vessel 20 via a lower pivot joint defining a lower pivot axis 46. Each of the support arms 42 also has an upper end 48 which is pivotably coupled to the cover frame 40 at an upper pivot joint defining an upper pivot axis 50. The nature of the upper and lower pivot joints is conventional and for example includes brackets fixed to the ends of the support arms 42, the hull of the marine vessel 20, and the cover frame 40. The brackets are connected together for example by one or more conventional fasteners or pivot pins along the noted lower and upper pivot axes 46, 50. Thus the support arms 42 are pivotable about the lower pivot axes 46, via the lower pivot joints, which in turn raises and lowers the cover frame 40, as can be seen by comparison of FIGS. 5 and 6. Referring to FIG. 7, the cover frame 40 is tiltable or pivotable forwardly and backwardly relative to the support arms 42, which determines the orientation of the cover frame 40 relative to the marine vessel 20, for example providing shade from the sun.

The bimini top 22 has port and starboard lower actuators 52 coupled to the lower ends 44 of the support arms 42, respectively, and to the hull 24 of the marine vessel 20. As further explained below, the lower actuators 52 are controllable and are configured to cause pivoting movement of the support arms 42 relative to the marine vessel 20, as shown by comparison of FIGS. 5 and 6.

Unlike prior art bimini apparatuses, the improved bimini top 22 according to the present disclosure also has port and starboard upper actuators 54 coupled to the upper ends 48 of the support arms 42, respectively, and to the cover frame 40. As further described herein below, the upper actuators 54 are also controllable, for example in synchrony with the lower actuators 52 and/or separately from the lower actuators 52. The upper actuators 54 are configured to pivot the cover frame 40 about the upper pivot axes 50 relative to the support arms 42, which provides control of the orientation of the cover frame 40 relative to the floor or deck 38 of the marine vessel 20, including but not limited to while the support arms 42 are stationary and/or while the support arms 42 are being pivoted relative to the marine vessel 20 by the lower actuators 52.

In the illustrated embodiment, the lower actuators 52 are linear actuators having a length that is extendible and retractable. The lower actuators 52 have a first end 56 pivotably coupled to the hull 24 of the marine vessel 20 via a pivot joint defining a pivot axis 58. The lower actuators 52 have an opposite, second end 60 pivotably coupled to the support arms 42, respectively, via lower lever arms 64. The lower lever arms 64 extend downwardly from the above-noted pivot joints defining the pivot axes 46, particularly at the lower ends 44 of the support arms 42, for example downwardly from the noted brackets. The lower lever arms 64 can be fixed to or formed with the support arms 42 such that these components pivot together about the noted pivot axis 46. The second ends 60 of the lower actuators 52 are pivotably coupled to the lower ends of the lower lever arms 64 at a pivot axis 62, which again can be defined by a fastener or pin.

In the illustrated embodiment, the lower actuators 52 include a conventional bidirectional electric motor 66 which is operable to telescopically extend and retract an extension rod 68 into and between the positions shown in FIGS. 5-6, which in turn pivots the lower lever arms 64 and thus also the support arms 42 into and between the noted raised and lowered positions relative to the marine vessel 20. Port and starboard base members 70 which can be for example castings, cover and include or support the noted brackets and are fixed to the hull 24. Mounting brackets 72 are for fastening the first ends 56 of the lower actuators 52 to the hull 24, as shown.

In the illustrated embodiment, the upper actuators 54 are linear actuators having a first end 74 which is pivotably coupled to the upper end 48 of the respective support arm 42 by a pivot pin defining a pivot axis 76. The upper actuators 54 have an opposite, second end 78 which is pivotably coupled to an upper lever arm 82 extending from and rigidly connected to or formed with the cover frame 40. The second end 78 of the upper actuator 54 is coupled to the outer end of the upper lever arm 82 by a pivot pin defining a pivot axis 80.

In the illustrated embodiment, the upper actuators 54 include a conventional bidirectional electric motor 84 which is operable to telescopically extend and retract an extension rod 86 into and between the positions shown in FIGS. 5 and 6, which pivots the cover frame 40 about the upper pivot axes 50 relative to the support arms 42. This type of actuator is well known in the art, and suitable examples are available for purchase from Linak US Inc. Extension of the upper actuators 54 pushes the outer end of the upper lever arm 82 and the pivot axis 80 clockwise in the view shown in FIG. 5, and thus the pivots the cover frame 40 clockwise about the upper pivot axis 50 relative to the support arms 42. Retraction of the upper actuators pulls the outer end of the upper lever arm 82 and pivot axis 80 counter-clockwise in the view shown in FIG. 5, and thus pivots the cover frame 40 counter-clockwise about the pivot axis 50 relative to the support arms 42 (from the perspective of the views shown in FIG. 5).

The type and configuration of the lower and upper actuators 52, 54 can vary from what is shown and described. In other embodiments, the lower and upper actuators 52, 54 can be hydraulic actuators and/or combination hydraulic-electric actuators, and/or a different type of mechanical actuator such as a worm drive driven by a bidirectional electric motor and/or the like, and/or a combination of any of the above.

In non-limiting embodiments, the lower and upper actuators 52, 54 can be controlled by one or more user input devices 88 located with the bimini top 22 or located remotely from the bimini top 22, such as at the helm 39 in the embodiment shown in FIGS. 1-7. For example, the user input device(s) 88, can include one or more manually-operable electro-mechanical switches located at the helm 39 and communicatively connected by a wired or wireless link to the electric motors 66, 84 such that actuation of the switch(es) causes the electric motors 66, 84 to extend/retract the noted extension rods 68, 86. Optionally, the switches are momentary-style switches. Optionally, the switch(es) are three-way switches, wherein moving the respective switch into a first position causes the electric motors 66, 84 to extend the extension rods 68, 86, moving the respective switch into a different second position causes the electric motors 66, 84 to retract the extension rod 68, 86, and moving the respective switch into a different third position causes the electric motors 66, 84 to stop movement of the extension rods 68, 86.

In some embodiments, a single switch can be provided for simultaneously controlling both of the lower and upper actuators 52, 54. In other embodiments, two or more dedicated switches can be provided for separately controlling the lower and upper actuators 52, 54. In embodiments having dedicated switches for each of the lower and upper actuator 52, 54, an additional one or more switches can be provided for simultaneously controlling the lower and upper actuators 52, 54. In these embodiments, by operation of a dedicated switch corresponding to the upper actuator 54, the cover frame 40 can be independently pivoted relative to the support arms 42, for example as shown in FIG. 7, into a variety of tilted or angled (sunshade) positions, including both forwardly and backwardly angled or tilted positions. Optionally, this can occur while the support arms 42 remain stationary, or optionally this can occur while the support arms 42 are being moved by the lower actuators 52. It will thus be understood the above-described embodiments of the bimini top 22 advantageously enables a user to control the angle of the cover frame 40 relative to the support arms 42, for example in situations where the user desires to provide sunshade to someone standing on the deck 38. In other examples, by enabling tilting of the cover frame 40 relative to the support arms 42, the improved bimini top 22 advantageously allows the user easier access to items that may be temporarily stored in the cover frame 40, for example wakeboards, paddleboards, surfboards and/or the like.

In some embodiments, and particularly in embodiments having a dedicated switch for simultaneously controlling both of the lower and upper actuators 52, 54, the speeds of the lower and upper actuators 52, 54 are calibrated relative to each other during setup of the bimini top 22 such that while the lower actuators 52 are extended or retracted, the upper actuators 54 are automatically extended or retracted at the necessary speed and amount to continuously maintain the cover frame 40 in the generally horizontal orientation shown in the figures. Calibrating the relative speeds of the lower and upper actuators 52, 54 is within the ordinary skill in the art and for example can be accomplished by known actuators that are available for purchase, for example from Linak US Inc. Such actuators commonly have an internal controller or "IC" which is programmed by the manufacturer to enable reduction of the speed of the actuator. For example the IC limits the voltage to the motor 84, which slows the internal gearing of the actuator, thus slowing the speed the rod 68 extends or retracts. Typically this feature can be calibrated by the technician during installation, particularly for whichever of the upper and lower actuators 52, 54 are set to move faster than the other, such that the actuators 52, 54 move in synchrony in a way that maintains a horizontal attitude of the cover frame 40 relative to the deck 38.

Figure 8:
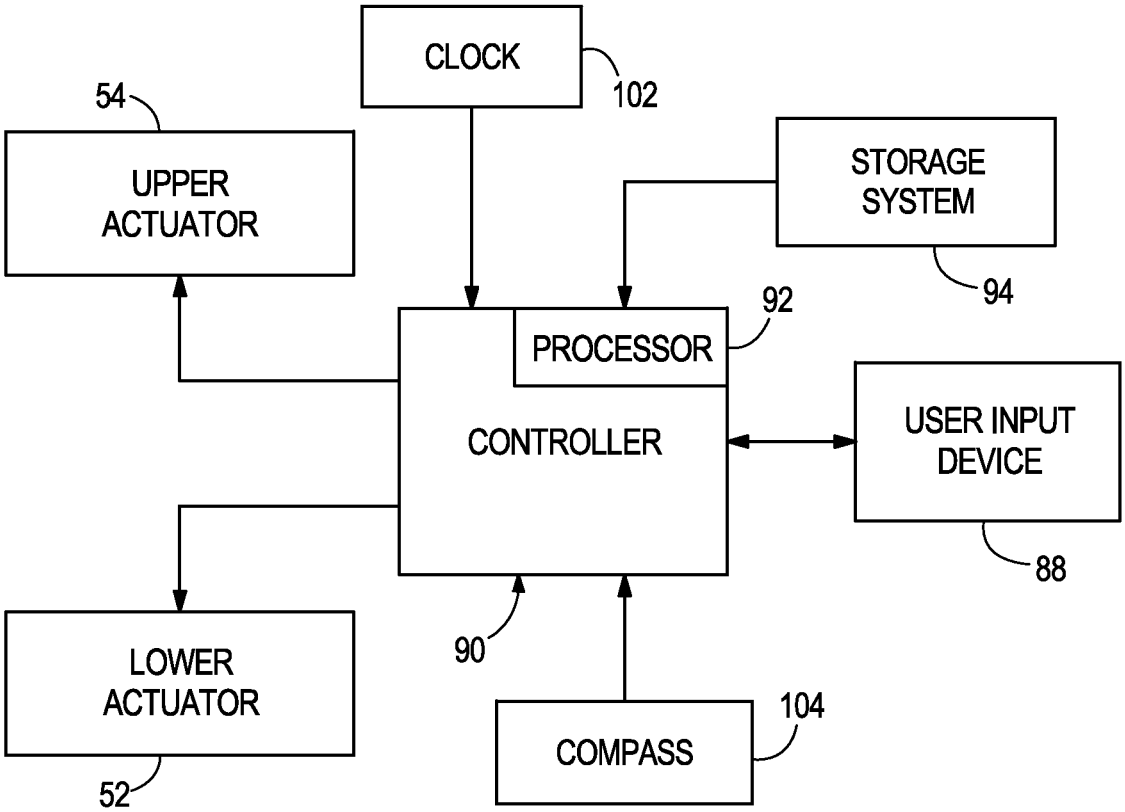
FIG. 8 is a schematic of a control system for the bimini top.

FIG. 8 depicts an alternate embodiment wherein a controller 90 is provided for controlling actuation of the lower and upper actuators 52, 54. The controller 90 has a processor 92 which is communicatively connected to a storage system 94 comprising a computer readable medium that includes volatile or nonvolatile memory upon which computer readable code and data is stored. The processor 92 can access the computer readable code and, upon executing the code, carry out functions, such as the controlling functions for the bimini top 22, as further described below. In alternate embodiments the controller 90 is part of a larger control network such as a controller area network (CAN) or CAN Kingdom network, such as disclosed in U.S. Pat. No. 6,273,771. A person of ordinary skill in the art will understand in view of the present disclosure that various other known and conventional computer control configurations could be implemented and are within the scope of the present disclosure, and that the control functions described herein may be combined into a single controller or divided into any number of distributed controllers which are communicatively connected.

In the illustrated embodiment, the controller 90 is in electrical communication with the lower and upper actuators 52, 54 via one or more wired and/or wireless links, as shown by lines and arrows in FIG. 8. In some embodiments, the wired and/or wireless links are part of a network, as described above. The controller 90 is configured to control the lower and upper actuators 52, 54 by sending and optionally by receiving said signals via the wired and/or wireless links. In the illustrated embodiment, the controller 90 is configured to send electrical signals to the lower and upper actuators 52, 54 that cause the electric motors 66, 84 to operate in a first direction to extend the extension rods 68, 86, and alternately that cause the electric motors 66, 84 to operate in an opposite, second direction to retract the extension rods 68, 86. In non-limiting embodiments, the controller 90 is configured to control the lower and upper actuators 52, 54 only to move into fully retracted and extended positions. In other non-limiting embodiments, the controller 90 is configured to control the lower and upper actuators 52, 54 into incremental length positions including and also between fully retracted and extended positions. In non-limiting embodiments, the controller 90 is configured to have independent control over the upper actuators 54 and the lower actuators 52, such that the controller 90 can independently control the lower actuators 52 apart from the upper actuators 54, and such that the controller 90 can independently control the upper actuators 54 apart from the lower actuators 52. The functional benefits of independent control over the lower and upper actuators 52, 54 are explained herein above and below.

In non-limiting embodiments, the controller 90 is configured to automatically control a speed and direction of operation of the electric motors 66, 84. In non-limiting embodiments, the controller 90 is configured to control the both the speeds and the directions of operation of the electric motors 66, 84 in particular such that while the lower actuators 52 are operated to pivot the support arms 42 (and thus change the vertical position of the cover frame 40 relative to the hull 24 of the marine vessel 20), the upper actuators 54 are operated at a speed that is calibrated to effectively match the speed of operation of the lower actuators 52 such that the cover frame 40 maintains a substantially constant, horizontal orientation during the change in vertical position. In non-limiting examples, a data set correlating the speed(s) of the lower and upper actuators 52, 54 necessary to maintain the horizontal orientation of the cover frame 40 is stored in the storage system 94 at set up, and thereafter is accessible by the processor 92. The controller 90 can be programmed to control the lower and upper actuators 52, 54 according to the data set and thus to consistently maintain the horizontal orientation of the cover frame 40.

In non-limiting embodiments, the controller 90 is configured to control the upper actuators 54 separately from the lower actuators 52, in particular to enable pivoting of the cover frame 40 relative to the support arms 42 while the support arms 42 remain stationary, or optionally also while the support arms 42 are moving. As shown by solid and dash-and-dot lines in FIG. 7, pivoting of the cover frame 40 relative to the support arms 42, for example while the support arms 42 are stationary, moves the cover frame 40 into a new orientation relative to the support arms 42 (shown in solid lines), for example when desired to provide sunshade and/or rain cover to a person in the boat. As described above, this functionality could also advantageously provide easier access for the user to items that are temporarily stored in on the cover frame 40, for example wakeboards, paddleboards, surfboards, and/or the like.

In non-limiting embodiments, the user input device 88 is configured to input a user-desired position the bimini top to the controller 90. Upon input of the user-desired position, the controller 90 is programmed to control the lower and/or upper actuators 52, 54 to move the bimini top 20 into the user desired position. The user input device 88 can include any conventional device that can be communicatively connected to the controller 90 for inputting a user-desired position to the controller 90, including but not limited to one or more switches, joysticks, touch pads, touch screens, and/or the like.

In a non-limiting example, the user input device 88 includes a touch screen that is communicatively connected to the controller 90. The touch screen can be located with the bimini top 22 or located remotely therefrom, for example at the helm 39 or on a personal handheld device such as a cell phone, or the like. The communicative connection between the touch screen and the controller 90 can be wired or wireless, including optionally via Bluetooth. In non-limiting embodiments, the controller 90 is configured to be remotely controllable via the user input device 88 by a person located apart from the marine vessel 20, for example from shore or by a person being towed by the marine vessel during watersports.

In non-limiting embodiments, the controller 90 and user input device 88 are configured to present the user with the ability to select from a plurality of sunshade positions of the cover frame 40 relative to the support arms 42, for example on a touch screen. The sunshade positions are stored in the storage system 94 and accessible by the processor 92. A data set correlating lengths of the upper actuator 54 to the various sunshade positions the storage system 94. User selection of one of the stored sunshade positions via the user input device 88 causes the controller 90 to access the data set and then control the upper actuators 54 based on the selected sunshade position to pivot the cover frame 40 to the selected position.

In non-limiting embodiments, the controller 90 and user input device 88 are configured to present the user with a plurality of vertical positions of the cover frame 40 relative to the marine vessel 20, for example on a touch screen, including for example a fully raised position (FIG. 2), a fully lowered position (FIG. 3), and/or any number of positions in between. A data set correlating lengths of the lower actuator 52 to vertical positions of the cover frame 40 is calibrated and stored in the storage system 94. User selection of one of the vertical positions via the user input device 88 causes the controller 90 to access the data set and then control the lower actuators 52 based on the selected vertical position to pivot the support arms 42 and cover frame 40 into the selected position. In this example, preferably, the controller 90 simultaneously controls the speeds of upper and lower actuators 52, 54 during movement thereof so as to maintain the horizontal orientation of the cover frame 40 as described herein above. In other embodiments, the speeds of the upper and lower actuators 52, 54 are pre-set during calibration of the bimini top 22 and the upper and lower actuators 52, 54 only operate at the pre-set speed, which is calibrated, as described herein above, to maintain the horizontal orientation of the cover frame 40.

In non-limiting embodiments, the controller 90 is programmed to automatically control the lower and upper actuators 52, 54 depending upon any of a number of characteristics of the marine vessel 20, including but not limited to time of day provided to the controller 90 by a clock 102, current heading direction provided to the controller 90 by a conventional compass or heading sensor 104.

In non-limiting examples, a data set correlating time of day and current heading of the marine vessel 20 to preferred sunshade positions of the cover frame 40 is stored in the storage system 94 and accessible by the processor 92. Depending on the time of day input to the controller 90 by a clock 102, the controller 90 can be programmed to automatically control the upper actuators 54 to tilt the sunshade into an appropriate sunshade position, which position can also be based on the current heading of the marine vessel 20. For example if according to the compass 104 the bow of the marine vessel 20 is facing east, and according to the clock 102 the time is in the late-afternoon, the controller 90 can be configured to automatically control the upper actuator 54 to pivot the cover frame 40 rearwardly about the support arms 42 into the tilted (sunshade) position shown in FIG. 7. Optionally, the controller 90 can be configured to first provide a warning to the operator of the marine vessel 20 via the user input device 88 and/or require the operator of the marine vessel 20 to first authorize the movement via the user input device 88 before enacting the change in sunshade position.

It will thus be understood by those having ordinary skill in the art that the present disclosure provides improved bimini top apparatuses that enable independent control over the angle of the cover frame 40 relative to the support arms 42 and relative to the marine vessel 20, which in turn permits automated control by the controller 90, for example during certain times of the day or in certain locations to provide sunshade cover, for example.

It will also thus be recognized that the above-described embodiments provide improved bimini top apparatuses which can be made more streamlined than the prior art, in particular by omitting the noted mechanical linkage, but yet retain the ability to control the orientation of the cover frame 40, preferably for example so that the cover frame 40 remains in a generally horizontal orientation during pivoting movement of the support arms, and also for example so that the cover frame 40 is independently pivotable relative to the support arms 42, for example to provide rain cover or sunshade.

This written description uses embodiments to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other embodiments that occur to those skilled in the art. Such other embodiments are intended to be within the scope of the claims if they have features or structural elements which do not differ from the literal language of the claims, or if they include equivalent features or structural elements with insubstantial differences from the literal languages of the claims.

What is claimed is:

1. A convertible bimini top for a marine vessel, the convertible bimini top comprising:

a cover frame, at least one support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, and an upper actuator coupled to the upper end of the support arm and to the cover frame, the upper actuator being configured to pivot the cover frame relative to the support arm, and a user input device configured to control the lower actuator and the upper actuator, wherein the user input device is configured to control the upper actuator independently of the lower actuator.

2. The convertible bimini top according to claim 1, wherein the user input device is configured to simultaneously control the upper actuator and the lower actuator.

3. The convertible bimini top according to claim 1, further comprising a controller configured to automatically control the upper actuator and the lower actuator based upon an input to the user input device.

4. A convertible bimini top for a marine vessel, the convertible bimini top comprising:

a cover frame, at least one support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, and an upper actuator coupled to the upper end of the support arm and to the cover frame, the upper actuator being configured to pivot the cover frame relative to the support arm, a user input device configured to control the lower actuator and the upper actuator, and a controller configured to automatically control the upper actuator and the lower actuator based upon an input to the user input device, wherein the user input device is configured to input a sunshade position of the cover frame to the controller, the sunshade position being angled relative to horizontal, and wherein based upon an input via the user input device the controller is configured to automatically control the upper actuator to pivot the cover frame relative to the support arm into the sunshade position.

5. A convertible bimini top for a marine vessel, the convertible bimini top comprising:

a cover frame, at least one support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, an upper actuator coupled to the upper end of the support arm and to the cover frame, the upper actuator being configured to pivot the cover frame relative to the support arm, a user input device configured to control the lower actuator and the upper actuator, and a controller configured to automatically control the upper actuator and the lower actuator based upon an input to the user input device, wherein the user input device is configured to input a vertical position of the cover frame relative to the marine vessel to the controller, and wherein based upon an input from the user input device the controller is configured to automatically control the lower actuator to pivot the support arm relative to the marine vessel until the cover frame is in the vertical position.

6. The convertible bimini top according to claim 5, wherein based upon the input from the user input device the controller is configured to also control the upper actuator to pivot the cover frame relative to the support arm, to continuously maintain a horizontal orientation of the cover frame while the support arm is being pivoted relative to the marine vessel.

7. The convertible bimini top according to claim 5, wherein the controller is configured to operate the lower actuator and the upper actuator to continuously pivot the support arm relative to the marine vessel while simultaneously continuously pivoting the cover frame relative to the support arm.

8. A convertible bimini top for a marine vessel, the convertible bimini top comprising:

a cover frame, at least one support arm for supporting the cover frame above the marine vessel, the support arm having a lower end configured to be pivotably coupled to the marine vessel and an upper end pivotably coupled to the cover frame, a lower actuator coupled to the lower end of the support arm, the lower actuator being configured to pivot the support arm relative to the marine vessel to move the cover frame up and down relative to the marine vessel, and an upper actuator coupled to the upper end of the support arm and to the cover frame, the upper actuator being configured to pivot the cover frame relative to the support arm, a user input device configured to control the lower actuator and the upper actuator, and a controller configured to automatically control the upper actuator and the lower actuator based upon an input to the user input device, wherein the controller is configured to automatically pivot the cover frame relative to the support arm based upon time of day and a current heading of the marine vessel.

9. The convertible bimini top according to claim 1, wherein the support arm comprises one of port and starboard support arms, each being configured to support the cover frame above the marine vessel and having the lower end configured to be pivotably coupled to the marine vessel and the upper end pivotably coupled to the cover frame, wherein the lower actuator comprises one of port and starboard actuators coupled to the lower end of a respective one of the port and starboard support arms and being configured to pivot the respective one of the port and starboard support arms relative to the marine vessel to move the cover frame up and down relative to the marine vessel, wherein the upper actuator comprises one of port and starboard actuators, each being coupled to the upper end of a respective one of the port and starboard support arms and to the cover frame, the port and starboard upper actuators being configured to pivot the cover frame relative to the respective one of the port and starboard support arms, and further wherein the user input device is configured to control the port and starboard lower actuators and the port and starboard upper actuators.

10. A marine vessel comprising:

a hull, a convertible bimini apparatus on the hull, the convertible bimini apparatus comprising a cover frame, at least one support arm for supporting the cover frame above the marine vessel, the support arm having a lower end pivotably coupled to the hull and an upper end pivotably coupled to the cover frame, a lower actuator coupled to the lower end of the support arm, the lower actuator being configured to pivot the support arm relative to the hull to move the cover frame up and down relative to the hull, and an upper actuator coupled to the upper end of the support arm and to the cover frame, the upper actuator being configured to pivot the cover frame relative to the support arm, a user input device configured to control the lower actuator and the upper actuator, a controller configured to automatically control the upper actuator and the lower actuator based upon an input to the user input device, wherein the controller is part of a control system that is further configured to control a propulsor for propelling the marine vessel in a body of water.

11. A marine vessel comprising:

a hull, a convertible bimini apparatus on the hull, the convertible bimini apparatus comprising a cover frame, at least one support arm for supporting the cover frame above the marine vessel, the support arm having a lower end pivotably coupled to the hull and an upper end pivotably coupled to the cover frame, a lower actuator coupled to the lower end of the support arm, the lower actuator being configured to pivot the support arm relative to the hull to move the cover frame up and down relative to the hull, and an upper actuator coupled to the upper end of the support arm and to the cover frame, the upper actuator being configured to pivot the cover frame relative to the support arm, a user input device configured to control the lower actuator and the upper actuator, a controller configured to automatically control the upper actuator and the lower actuator based upon an input to the user input device, wherein the controller is configured to automatically pivot the cover frame relative to the support arm based upon time of day and a current heading of the marine vessel.

* * * * *